US011230428B2

(12) United States Patent
Bublitz et al.

(10) Patent No.: US 11,230,428 B2
(45) Date of Patent: Jan. 25, 2022

(54) NESTED DUNNAGE ARRANGEMENT

(71) Applicant: Bradford Company, Holland, MI (US)

(72) Inventors: Timothy A. Bublitz, Grand Haven, MI (US); Brian T. Dobrinski, Zeeland, MI (US); Cody Commons, Allegan, MI (US)

(73) Assignee: Bradford Company, Holland, MI (US)

( * ) Notice: Subject to any disclaimer, the term of this patent is extended or adjusted under 35 U.S.C. 154(b) by 239 days.

(21) Appl. No.: 16/433,740

(22) Filed: Jun. 6, 2019

(65) Prior Publication Data

US 2020/0071064 A1 Mar. 5, 2020

Related U.S. Application Data

(60) Provisional application No. 62/681,425, filed on Jun. 6, 2018.

(51) Int. Cl.
*B65D 85/62* (2006.01)
*B65D 25/10* (2006.01)

(52) U.S. Cl.
CPC ..... *B65D 85/62* (2013.01); *B65D 25/108* (2013.01)

(58) Field of Classification Search
CPC ..... B65D 85/62; B65D 25/108; B65D 25/10; B65D 19/44
USPC ..... 206/499, 779, 488
See application file for complete search history.

(56) References Cited

U.S. PATENT DOCUMENTS 3,414,132 A * 12/1968 Cornu ..... B65D 73/0007 211/74
4,860,894 A * 8/1989 Koenig ..... B65D 85/42 206/421
6,076,663 A * 6/2000 Shima ..... A45C 3/02 206/216
8,499,931 B2 * 8/2013 Hsi ..... B65D 85/06 206/303

* cited by examiner

*Primary Examiner* — Steven A. Reynolds
(74) *Attorney, Agent, or Firm* — Barnes & Thornburg LLP

(57) ABSTRACT

A nested dunnage arrangement is provided for compactly storing or transporting parts, each having a concave surface defining a cavity and a convex surface opposite the concave surface, and includes a panel defining an opening, and means for positioning a first part on one face of the panel with the concave surface of the first part facing the opening. The opening is sized to receive therein from an opposite face of the panel a convex surface of a second part such that the convex surface of the second part extends through the opening and at least partially into the cavity of first part. A periphery of the opening is configured to engage the convex surface of the second part received therein to nest the second part within the first part while also preventing the convex surface of the second part from contacting the concave surface of the first part.

15 Claims, 7 Drawing Sheets

NESTED DUNNAGE ARRANGEMENT

CROSS-REFERENCE TO RELATED APPLICATION

This patent application claims the benefit of and priority to U.S. Provisional Patent Application Ser. No. 62/681,425, filed Jun. 6, 2018, the disclosure of which is expressly incorporated herein by reference in its entirety.

FIELD OF THE DISCLOSURE

The present disclosure relates generally to dunnage arrangements, and more specifically to dunnage arrangements for nesting parts to be transported and/or stored.

BACKGROUND

Conventional containers for storing and/or transporting parts typically isolate the parts from one another by suitable dunnage material. In some example implementations, parts may be placed in separate compartments isolated from other compartments by dunnage material. In other example implementations, parts may be arranged in rows and/or columns likewise separated from one another by dunnage material. In many packing arrangements, parts density per container may be an important consideration in the design of the container and/or of the dunnage arrangement.

SUMMARY

The present disclosure may comprise one or more of the features recited in the attached claims, and/or one or more of the following features and combinations thereof. In one aspect, a nested dunnage arrangement for compactly storing or transporting parts each having a concave surface defining a cavity and a convex surface opposite the concave surface, may comprise a first panel defining a first opening therethrough, and means for positioning and retaining a first one of the parts on one face of the first panel with the concave surface and the cavity of the first part facing and aligned with the first opening of the first panel. The first opening may be sized to receive therein from an opposite face of the first panel a convex surface of a second one of the parts such that the convex surface of the second part extends through the first opening and at least partially into the cavity of first part. At least a portion of a periphery of the first opening may be configured to engage the convex surface of the second part received therein to nest at least a portion of the convex surface of the second part within the cavity of the first part while also preventing the convex surface of the second part from contacting the concave surface of the first part.

In another aspect, a nested dunnage arrangement for compactly storing or transporting parts each having a concave surface defining a cavity and a convex surface opposite the concave surface, may comprise a first panel defining a first opening therethrough, and a first plurality of gibs mounted to one face of the first panel at least partially about a periphery of the first opening, the first plurality of gibs configured to engage and retain a first one of the parts on the one face of the first panel with the concave surface and the cavity of the first part facing and aligned with the first opening of the first panel. The first opening may be sized to receive therein from an opposite face of the first panel a convex surface of a second one of the parts such that the convex surface of the second part extends through the first opening and at least partially into the cavity of first part. At least a portion of a periphery of the first opening may be configured to engage the convex surface of the second part received therein to nest at least a portion of the convex surface of the second part within the cavity of the first part while also preventing the convex surface of the second part from contacting the concave surface of the first part.

In yet another aspect, a nested dunnage arrangement for compactly storing or transporting parts each having a concave surface defining a cavity and a convex surface opposite the concave surface, may comprise a dunnage container, a plurality of panels spaced apart from one another in the dunnage container, each of the plurality of panels defining at least one opening therethrough, and a plurality of part retaining structures each coupled to one face of a respective one of the plurality of panels at least partially about the at least one opening defined therethrough. Each of the plurality of part retaining structures may be configured to receive and retain a respective one of the parts on the one face of a respective one of the plurality of panels with the concave surface and the cavity of the respective part facing and aligned with the at least one opening defined through the respective one of the plurality of panels. The at least one opening defined through each of the plurality of panels may be sized to receive therein from an opposite face of the panel a convex surface of another of the parts carried by one of the plurality of part retaining structures coupled to an adjacent one of the plurality of panels such that convex surface of the another part extends through the at least one opening and at least partially into the cavity of the one part. At least a portion of a periphery of the at least one opening defined through each of the plurality of panels may be configured to engage the convex surface of the another part received therein to nest at least a portion of the convex surface of the another part within the cavity of the one part while also preventing the convex surface of the another part from contacting the concave surface of the one part.

DETAILED DESCRIPTION OF THE DRAWINGS

Figure 1B:
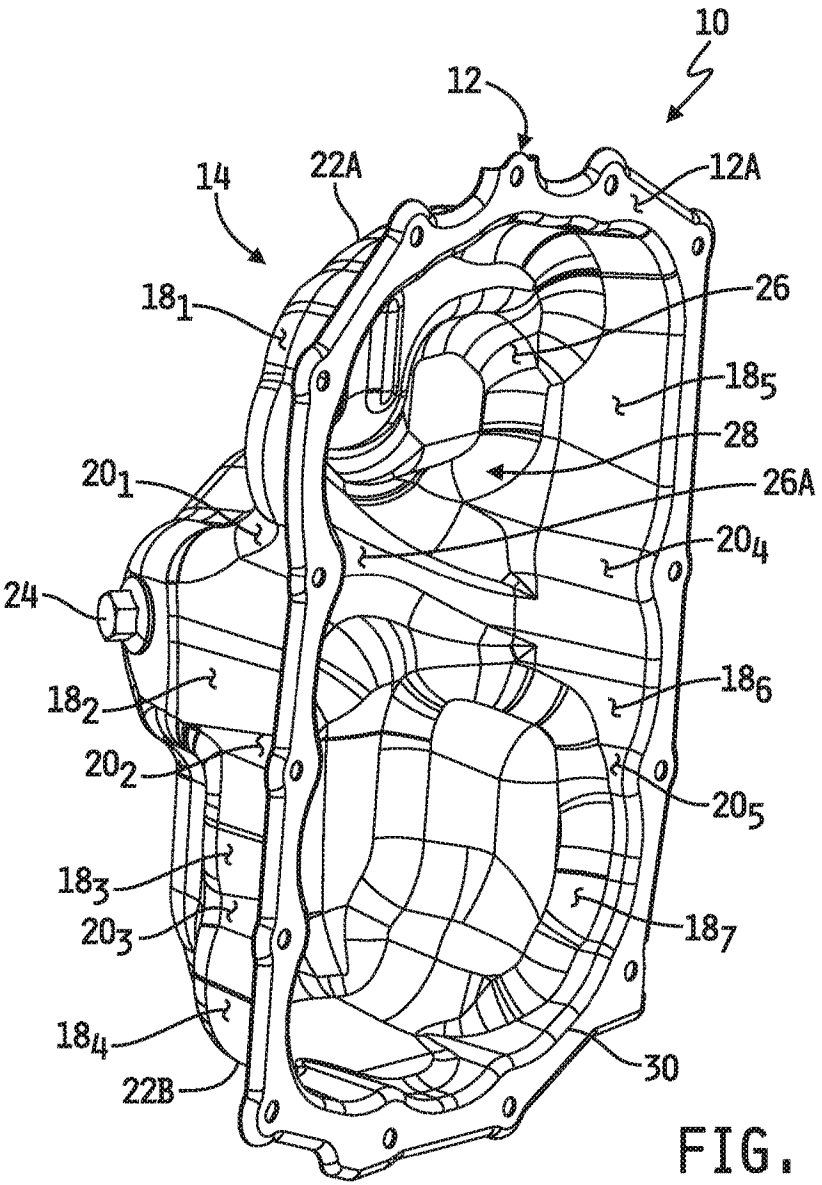
FIG. 1B is a perspective view of the part illustrated in FIG. 1A.

While the concepts of the present disclosure are susceptible to various modifications and alternative forms, specific example embodiments thereof are shown in the drawings and will herein be described in detail. It should be understood, however, that there is no intent to limit the concepts of the present disclosure to the particular forms disclosed and illustrated; rather, the intention is to cover all modifications, equivalents, and alternatives consistent with the present disclosure and the appended claims.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases may or may not necessarily refer to the same embodiment. Further, when a particular feature, structure or characteristic is described in connection with an embodiment, it is submitted that it is within the knowledge of one skilled in the art to effect such feature, structure or characteristic in connection with other embodiments whether or not explicitly described. Further still, it is contemplated that any single feature, structure or characteristic disclosed herein may be combined with any one or more other disclosed feature, structure or characteristic, whether or not explicitly described, and that no limitations on the types and/or number of such combinations should therefore be inferred.

This disclosure is directed to a dunnage arrangement for storing and/or transporting nestable parts. With such an arrangement, increased packing and shipping densities can be realized. For purposes of the following description, the phrases "nestable parts," "nested parts" and variants thereof refer to parts with one side defining a concave surface defining a cavity in the part and a second side, opposite the first, defining a convex surface which, when two such parts are brought together with the first side of one facing the second side of the other, the convex surface of the second part is received within the cavity of the first part such that the two parts "nest" together, wherein the term "nest" is used in accordance with its ordinary meaning. Examples of nestable parts include, but are not limited to, bowls, pans, tubs, trays, containers, housings, and the like. In some embodiments, nestable parts may be identical to one another and in other embodiments nestable parts may differ from one another in size, shape or other feature. In any case, it will be understood that the convex surface of one nestable part need not be identical in shape and/or size to the concave surface of another part in which it will nest; rather, it is only necessary for purposes of this disclosure that the convex surface of one such part be nestable within the cavity of the other.

Figure 1A:
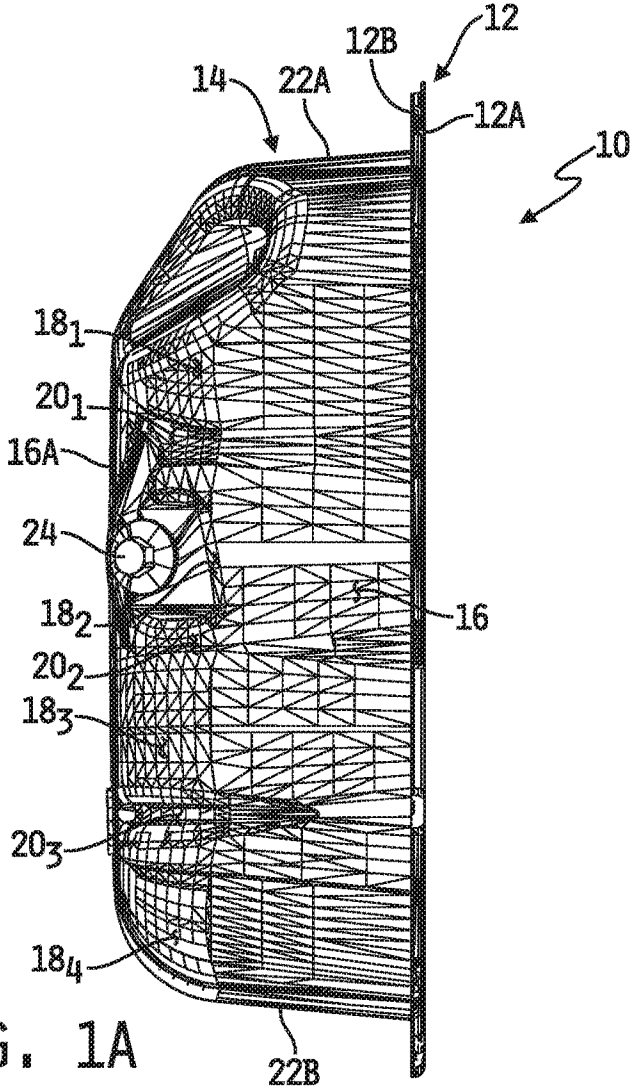
FIG. 1A is a side elevational view of a part having opposing concave and convex surfaces.

Referring to FIGS. 1A and 1B, an example is shown of a nestable part 10. The example nestable part 10 is illustratively an oil pan for an automotive application, although it will be understood that the part 10 is provided only by way of example to illustrate the concepts and features of the nested dunnage arrangement of this disclosure, and that the nested dunnage arrangement illustrated in the figures and described herein may be suitably modified for other nestable parts. Those skilled in the art will recognize that any such modifications of the nested dunnage arrangement described herein will involve only mechanical steps for a skilled artisan.

In the example illustrated in FIGS. 1A and 1B, the part 10 includes a flange 12 extending about a periphery of the part 10, and a body or shell 14 extending away from the flange 12. A planar surface 12A of the flange 12 faces in a direction opposite to the body or shell 14, and another planar surface 12B of the flange 12 opposite the planar surface 12A faces in the same direction as the body or shell 14. The body or shell 14 defines a generally convex surface 16 between the planar surface 12B of the flange 12 and a closed bottom surface 16A as illustrated in FIG. 1A. As illustrated in FIG. 1B, the body or shell 14 likewise defines a generally concave surface 26 between the planar surface 12A of the flange 12 and a closed bottom surface 26A opposite the closed bottom surface 16A of the convex surface 16.

As depicted in both of FIGS. 1A and 1B, the body or shell 14 of the part 10 illustratively defines a number of nesting keys along the sides thereof adjacent to the closed bottom surfaces 16A, 26A of the respective convex and concave surfaces 16, 26. In the illustrated example, three such nesting keys $\mathbf{20}_1$-$\mathbf{20}_3$ are spaced apart along one side of the shell or body 14 between respective border regions $\mathbf{18}_1$-$\mathbf{18}_4$ of the shell or body 14, and two such nesting keys $\mathbf{20}_4$ and $\mathbf{20}_5$ are spaced apart along the opposite side of the shell or body 14 between respective border regions $\mathbf{18}_5$-$\mathbf{18}_7$ of the shell or body 14. A top region 22A of the shell or body 14 extends between the border regions $\mathbf{18}_1$ and $\mathbf{18}_5$, and a bottom region 22B of the shell or body 14 extends between the border regions $\mathbf{18}_4$ and $\mathbf{18}_7$. A drain plug 24 is illustratively fitted into a drain opening (not shown) formed through the border region $\mathbf{18}_2$.

In the illustrated embodiment, the nesting keys $\mathbf{20}_1$-$\mathbf{20}_5$ are illustratively provided in the form of recesses which extend into the convex surface 16 and which extend generally from the bottom surface 16A of the part 10 toward the flange 12. In some alternate embodiments, the part 10 may define more or fewer such nesting keys, and in other alternate embodiments in which the cross-sectional area of the body or shell 14 is not constant the part 10 may not include any nesting keys. In still other alternate embodiments, one or more of the nesting keys $\mathbf{20}_1$-$\mathbf{20}_5$ may be raised relative to respective ones of the border regions $\mathbf{18}_1$-$\mathbf{18}_7$, and in further alternate embodiments one or more of the border regions $\mathbf{18}_1$-$\mathbf{18}_7$ may be recessed into the convex surface relative to one or more of the nesting keys $\mathbf{20}_1$-$\mathbf{20}_5$.

The concave surface 16 of the part 10 illustratively defines a cavity 28 which extends into the body or shell 14 from the flange 12 to the bottom surface 26A of the concave surface 16 and which is bordered by the concave surface 16. In the illustrated embodiment, the cross-sectional area of the cavity 28 adjacent to the closed bottom surfaces 16A, 26A is less than the cross-sectional area of the cavity 28 adjacent to the flange 12, and the convex and concave surfaces 16, 26 continuously slope from an open end 30 of the cavity 28 to the bottom surface 26A thereof.

Figure 2A:
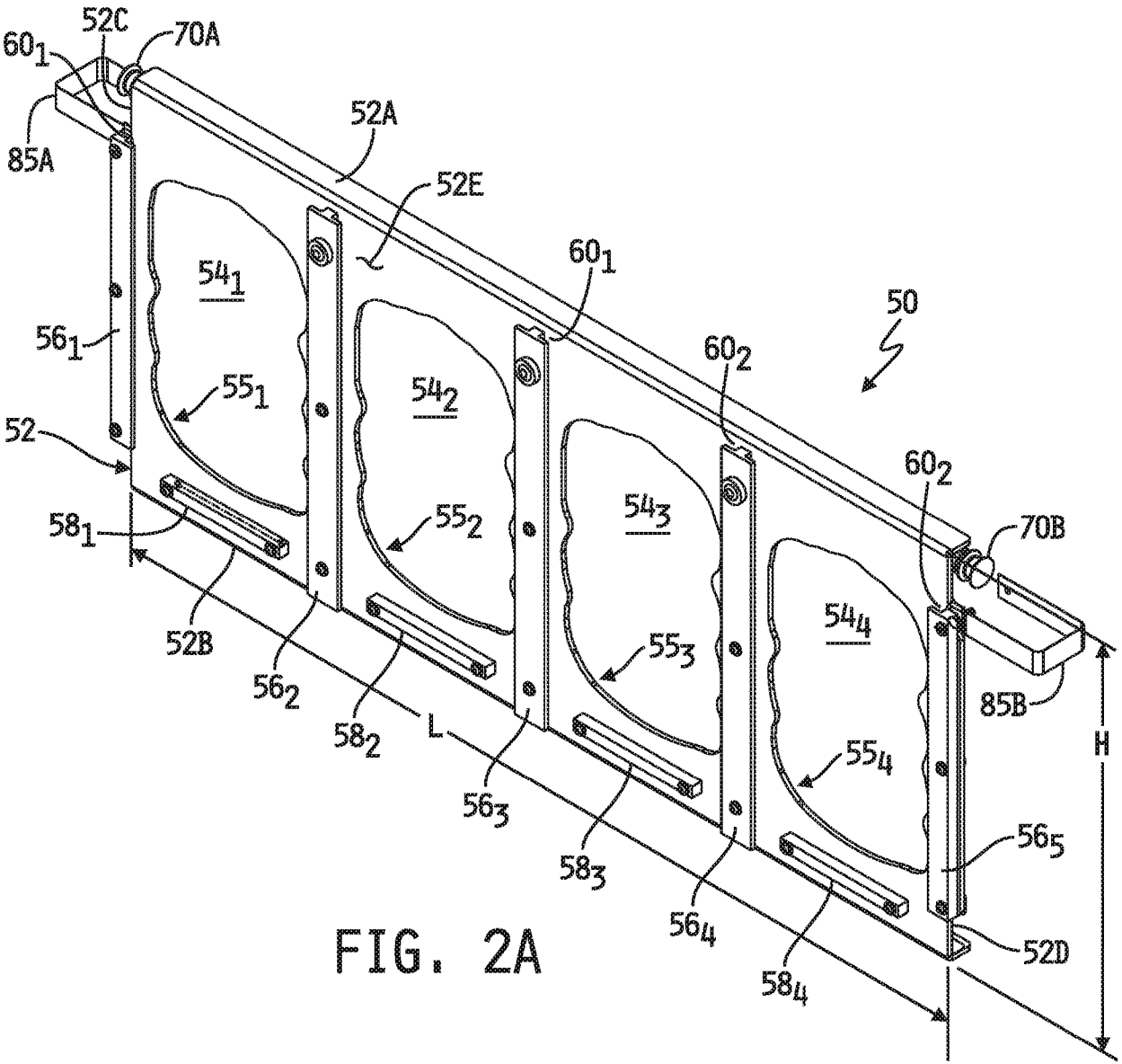
FIG. 2A is a perspective view of one face of an embodiment of a dunnage carrier for carrying parts of the type illustrated in FIGS. 1A and 1B.
Figure 2B:
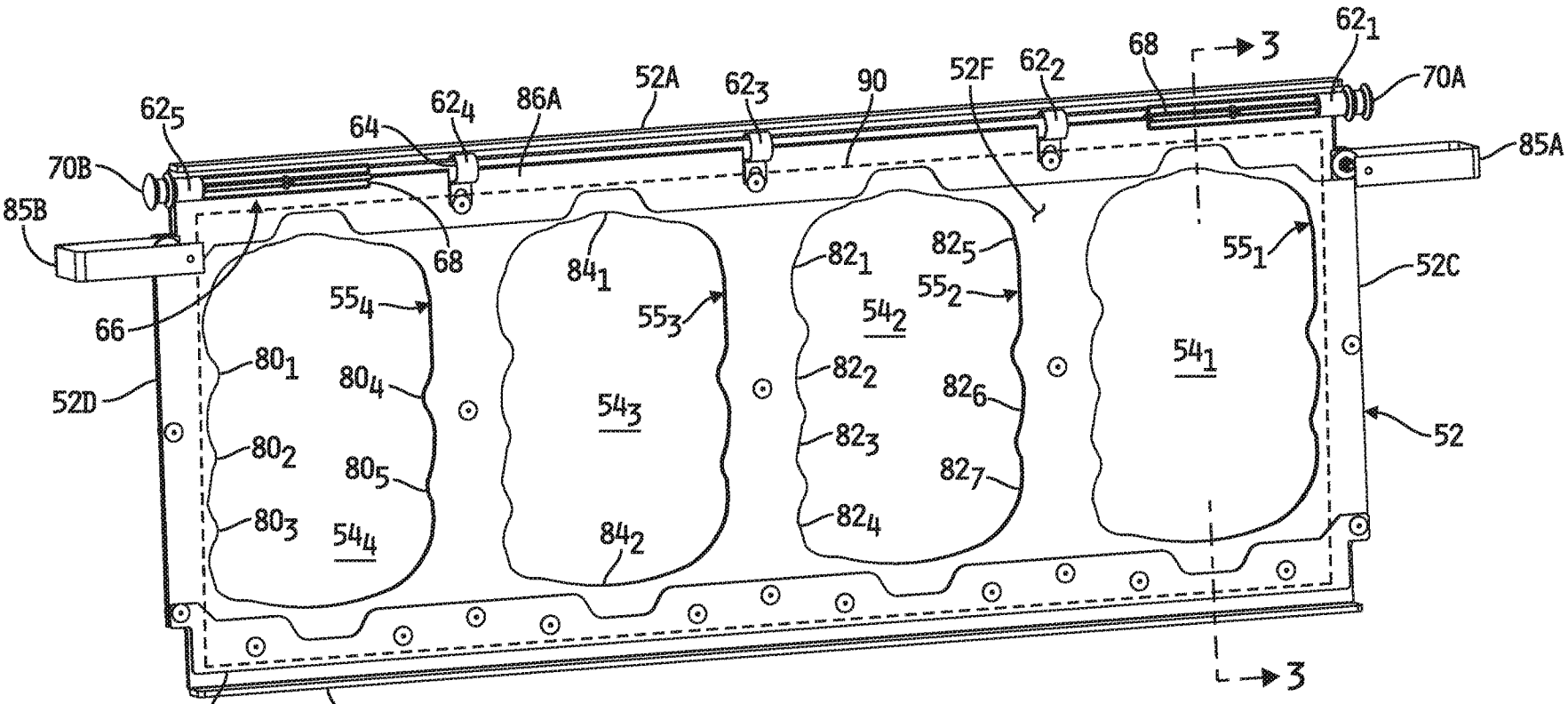
FIG. 2B is a perspective view of an opposite face of the dunnage carrier illustrated in FIG. 2A.

Referring now to FIGS. 2A and 2B, an embodiment is shown of a nesting carrier 50 configured to hold and position at least a first part 10 and to engage a second part 10 so as to at least partially nest, in non-contacting relationship, the second part within the first. In the illustrated embodiment, the nesting carrier 50 includes a panel 52 having a top 52A, a bottom 52B opposite the top 52A, opposite sides 52C, 52D extending between the top 52A and the bottom 52B and opposite faces 52E, 52F defined between the top 52A, bottom 52B and sides 52C, 52D. The panel 52 defines at least one opening therethrough for nesting one part 10 within another 10 as just described, and in the illustrated embodiment the panel 52 defines four such openings $\mathbf{54}_1$-$\mathbf{54}_4$ therethrough. Alternate embodiments may include more or fewer such openings. In any case, each opening $\mathbf{54}_1$-$\mathbf{54}_4$ defines a respective periphery $\mathbf{55}_1$-$\mathbf{55}_4$ defined by a boundary of the panel 52 defining the respective opening $\mathbf{54}_1$-$\mathbf{54}_4$.

One or more part retaining structures are illustratively affixed, mounted or otherwise coupled to the face 52E of the panel 52 about each of the openings 54 to position a respective part 10 to position the part 10 for nesting with another part. In the illustrated embodiment, such retaining structures are provided in the form of elongated gibs $\mathbf{56}_1$-$\mathbf{56}_5$ positioned between the top 52A and bottom 52B of the panel 52 and extending alongside, and spaced apart from, each of the openings $\mathbf{54}_1$-$\mathbf{54}_4$, and in the form of stops $\mathbf{58}_1$-$\mathbf{58}_4$ positioned along the bottom 52B of the panel 52 between respective ones of the gibs $\mathbf{56}_1$-$\mathbf{56}_5$ and spaced apart from respective ones of the openings $\mathbf{54}_1$-$\mathbf{54}_4$. The gibs $\mathbf{56}_2$-$\mathbf{56}_4$ each illustratively define channels $\mathbf{60}_1$, $\mathbf{60}_2$ along opposite sides thereof which face a respective one of the openings $\mathbf{54}_1$-$\mathbf{54}_4$, and the gibs $\mathbf{56}_1$ and $\mathbf{56}_5$ each define a single channel $\mathbf{60}_1$, $\mathbf{60}_2$ along one side thereof which faces a respective one of the openings $\mathbf{54}_1$, $\mathbf{54}_4$.

The channels $\mathbf{60}_1$, $\mathbf{62}_2$ are each illustratively sized to slidingly receive and retain therein a portion of the flange 12 extending along a respective side of the part 10, and the gibs $\mathbf{56}_1$-$\mathbf{56}_5$ are spaced apart between respective ones of the opening $\mathbf{54}_1$-$\mathbf{54}_4$ such that the flange 12 on opposite sides of a single part 10 may be slidingly received within opposite channels $\mathbf{60}_1$, $\mathbf{60}_2$ along the face 52E of the panel 52 to position the part 10 on or adjacent the face 52E with the opening 30 of the cavity 28 facing a respective one of the openings $\mathbf{54}_1$-$\mathbf{54}_4$. Illustratively, the gibs $\mathbf{56}_1$-$\mathbf{56}_5$ are positioned relative to the openings $\mathbf{54}_1$-$\mathbf{54}_4$ such the cavities 28 of parts 10 positioned within respective ones of the gibs $\mathbf{56}_1$-$\mathbf{56}_5$ are oriented, e.g., centered, horizontally with respect to the openings $\mathbf{54}_1$-$\mathbf{54}_4$. The stops $\mathbf{58}_1$-$\mathbf{58}_4$ serve as resting surfaces supporting the flanges 12 extending about the bottom regions 22B of parts 10 received within and between respective ones of the gibs $\mathbf{56}_1$-$\mathbf{56}_5$, and thus supporting the parts 10 positioned on or adjacent to the face 52E of the panel 52. The stops $\mathbf{58}_1$-$\mathbf{58}_4$ are illustratively spaced apart from the bottom edges of the openings $\mathbf{54}_1$-$\mathbf{54}_4$ such that the cavities 28 of parts 10 having flanges 12 supported on and by the stops $\mathbf{58}_1$-$\mathbf{58}_4$ are oriented, e.g., centered, vertically with respect to the openings $\mathbf{54}_1$-$\mathbf{54}_4$.

In some alternate embodiments, one or more of the gibs $\mathbf{56}_1$-$\mathbf{56}_5$ may be combined with one or more of the stop members 58 to form unitary pieces. In other alternate embodiments, one or more of the gibs $\mathbf{56}_1$-$\mathbf{56}_5$ and/or one or more of the stop members $\mathbf{58}_1$-$\mathbf{58}_4$ may be provided in multiple parts each of which may be separately attached to the panel 52, or which may be assembled together prior to attachment to the panel 52. In still other alternate embodiments, one or more of the gibs $\mathbf{56}_1$-$\mathbf{56}_5$ may include stop surfaces or structures within the channels $\mathbf{60}_1$, $\mathbf{60}_2$ at or adjacent to the bottom 52B of the panels 52, and in such embodiments one or more of the stop member $\mathbf{58}_1$-$\mathbf{58}_4$ may be omitted. Those skilled in the art will recognize other part retaining structures that may be used in place of or in addition to the gibs $\mathbf{56}_1$-$\mathbf{56}_5$ and stop members $\mathbf{58}_1$-$\mathbf{58}_4$, and it will be understood that any such other part retaining structures are intended to fall within the scope of this disclosure.

A panel support member 66 is illustratively coupled to the panel 52 for supporting the nesting carrier 50 within a container with the parts 10 positioned such that their cavities 28 open horizontally as illustrated by example in FIGS. 3 and 4A-5. In the illustrated embodiment, the panel support member 66 is provided in the form of an elongated pole 68 coupled at opposite ends to a respective glide member 70A, 70B (only end portions of the pole 68 are illustrated in FIG. 2B). The glide members 70A, 70B are illustratively configured to slide along guide tracks mounted to and/or within a container. In any case, in embodiments in which the panel support member 66 is provided in the form of an elongated pole 68, the nesting carrier 50 further includes a number of retaining members mounted, affixed or otherwise coupled to the panel 52 at or adjacent to the top 52A each configured to engage and retain a respective portion of the elongated pole 68. In the illustrated embodiment, five such retaining members $\mathbf{62}_1$-$\mathbf{62}_5$ are spaced apart along the top 52A of the panel 52 and each is affixed to the panel 52 and to a respective one of the gibs $\mathbf{56}_1$-$\mathbf{56}_5$. The retaining members $\mathbf{62}_1$-$\mathbf{62}_5$ are each provided in the form of a closed loop defining a passageway 64 therethrough sized to receive the elongated pole 68 axially therethrough. It will be understood that alternate embodiments may include more or fewer retaining members $\mathbf{62}_1$-$\mathbf{62}_5$ and/or retaining members of different design but configured to engage, slidingly or otherwise, the elongated pole 66. In other alternate embodiments, the pole 68 may be omitted and the panel support member 66 may include only the glide member 70A mounted, affixed or otherwise coupled to the panel 52 at or adjacent to the top 52A and at or adjacent to the side 52C thereof, and the glide member 70B mounted, affixed or otherwise coupled to the panel 52 at or adjacent to the top 52A and at or adjacent to the side 52D thereof.

In some embodiments, as illustrated by example in FIG. 2B, one or more flexible, semi-flexible, rigid and/or semi-rigid reinforcement and/or support panels or plates may be mounted to one or both faces 52E, 52F of the panel 50 for the purpose of reinforcing the panel 50 in and along areas to which panel/part support structures are mounted. As one example, a panel or plate 86A may be mounted to the panel 50 along the face 52F of the panel 50 between the top 52A thereof and the tops $\mathbf{84}_1$ of the openings $\mathbf{54}_1$-$\mathbf{54}_4$ for the purpose of reinforcing the panel 50 in and along the areas thereof to which the retaining members $\mathbf{62}_1$-$\mathbf{62}_5$ are mounted. As another example, a panel or plate 86B may be mounted to the panel 50 along the face 52F of the panel 50 between the adjacent to the bottom 52B thereof for the purpose of reinforcing the panel 50 in and along areas thereof to which the stop members $\mathbf{58}_1$-$\mathbf{58}_4$ are mounted. Those skilled in the art will recognize that the panel 50 may include either or both, or neither, of the panels or plate 86A, 86B, and that one or more other reinforcement panels, plates or other structures may be mounted to either or both faces 50 of the panel 50.

Figure 4A:
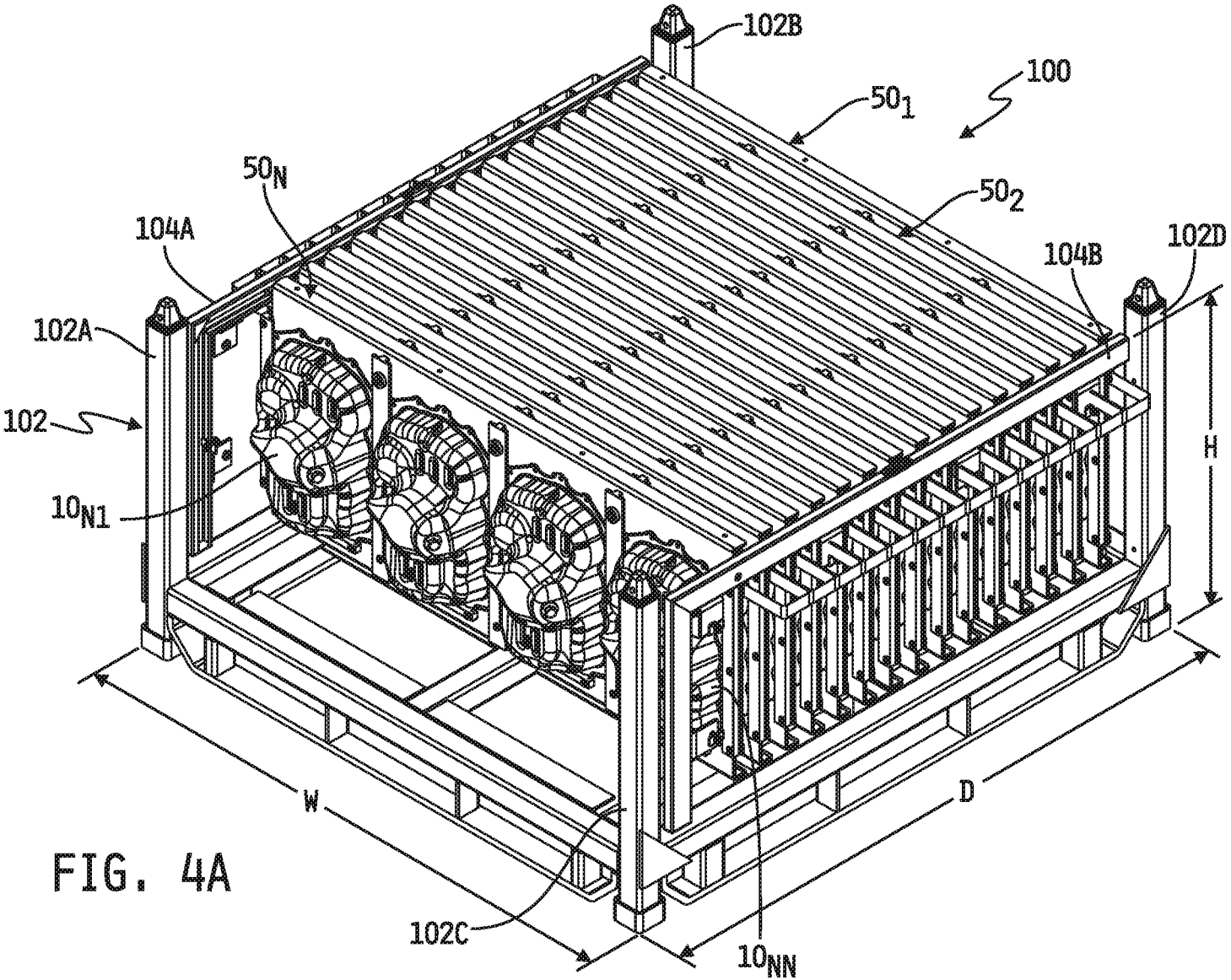
FIG. 4A is a perspective view of an embodiment of a dunnage container having a plurality of dunnage carriers of the type illustrated in FIGS. 2A and 2B positioned fact-to-face therein such that parts carried by each are nested with parts carried by adjacent dunnage carriers.
Figure 4B:
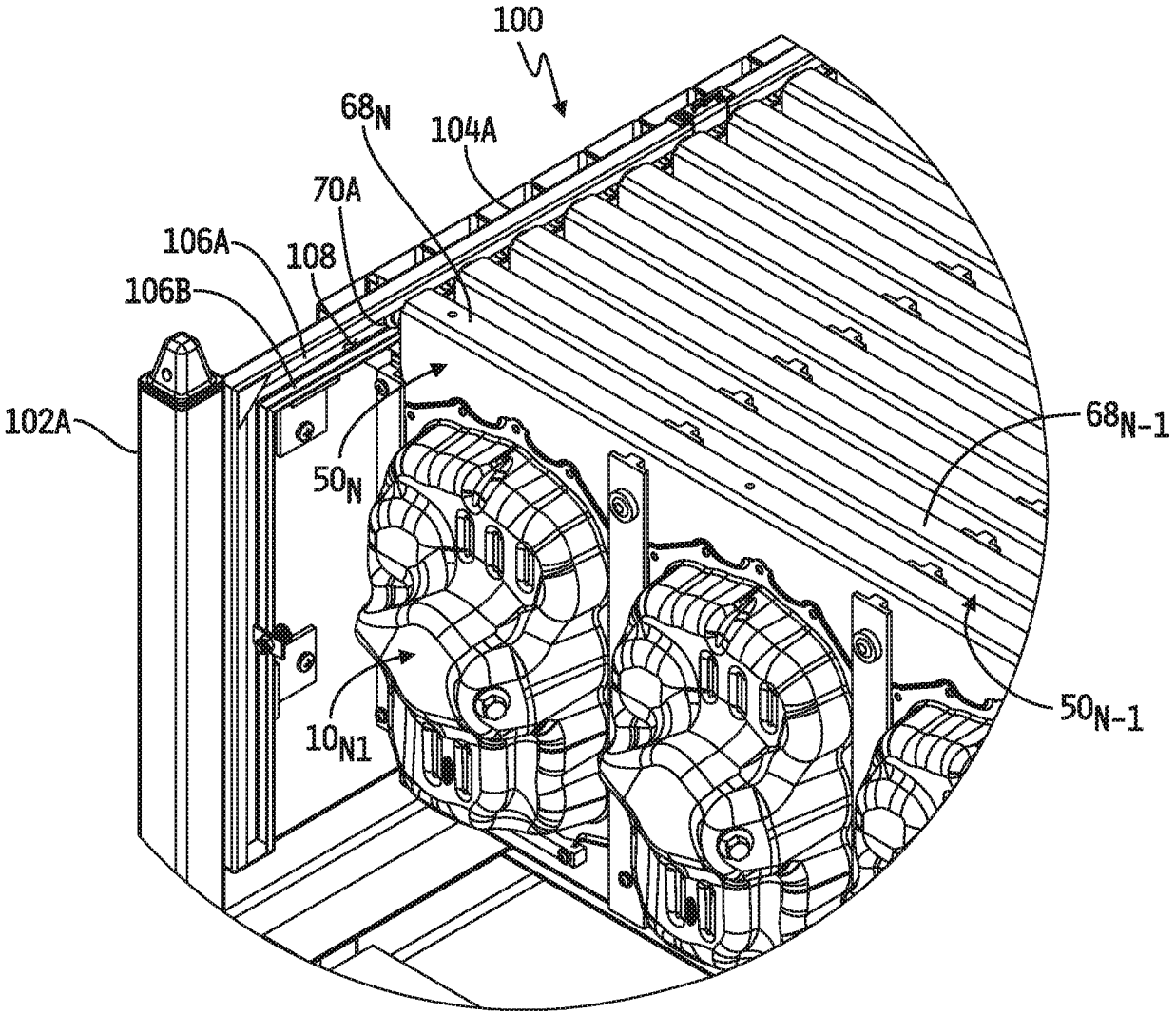
FIG. 4B is a magnified view of a portion of the dunnage container of FIG. 4A illustrating an embodiment of gliders coupled to opposite sides of the dunnage carriers and of a corresponding a guide rail coupled to the dunnage container for guiding movement of the gliders.
Figure 5:
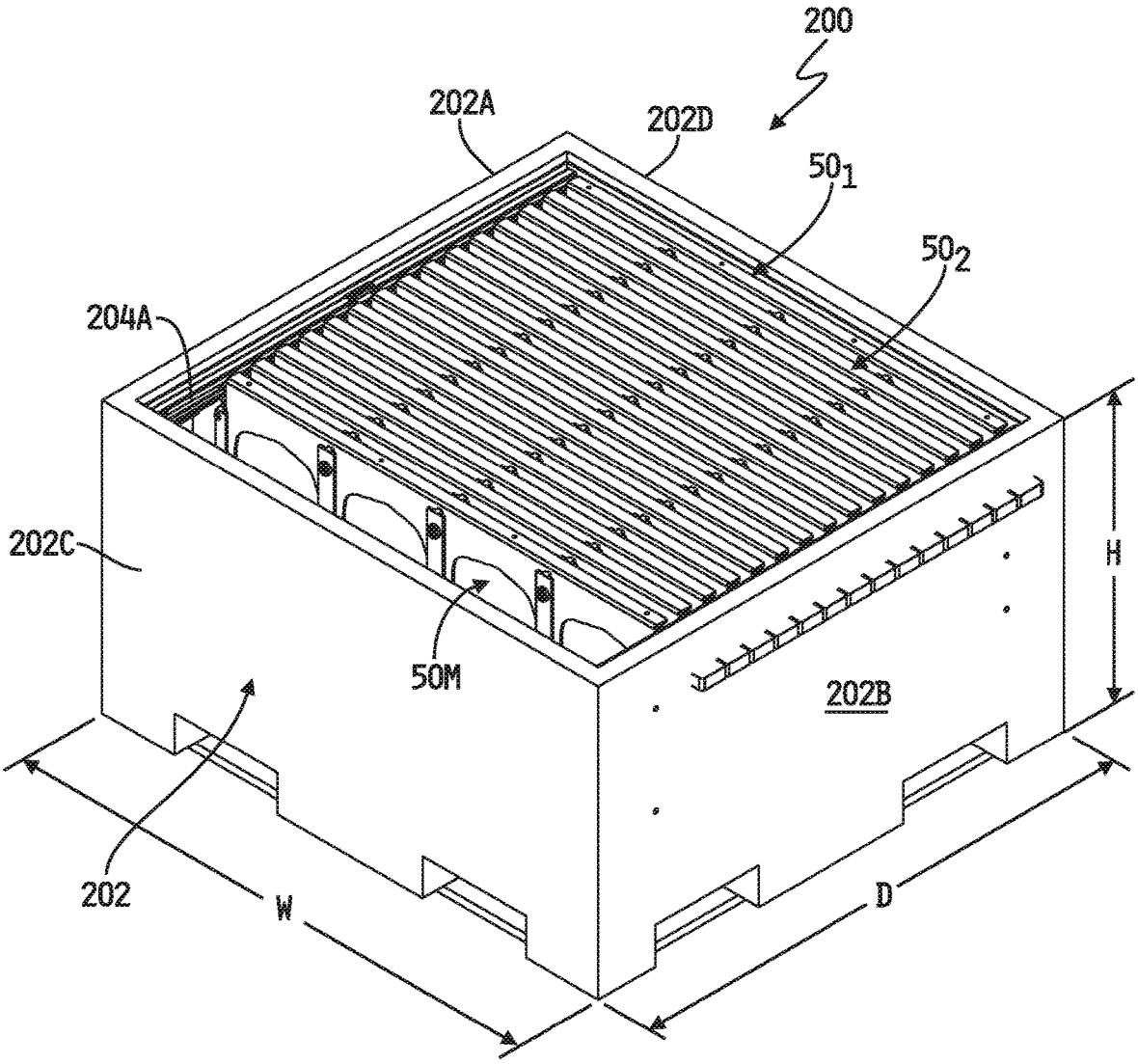
FIG. 5 is a perspective view of another embodiment of a dunnage container having a plurality of dunnage carriers of the type illustrated in FIGS. 2A and 2B positioned fact-to-face therein such that parts carried by each are nested with parts carried by adjacent dunnage carriers.

In some embodiments in which multiple panels 50 are supported in a dunnage container, e.g., see FIGS. 4A-5, two or of the multiple panels 50 may be outfitted with one or more flexible or semi-flexible straps configured to attach two adjacent ones of the panels 50 together. An example of this feature is illustrated in FIGS. 2A and 2B in which ends of flexible straps 85A, 85B are attached to the panel 50 at or adjacent to respective sides 52C, 52D thereof. The opposite ends of the straps 85A, 85B are attachable to an adjacent panel 50 in a dunnage container for limiting the distance between such adjacent panels 50. It will be understood that, in embodiments which include this feature, more or fewer two straps 85A, 85B may be included. It will be further understood that, while the ends of the straps 85A, 85B are shown attached to, or adjacent to, the panel sides 52C, 52D below the top 52A of the panel 50, the strap 85A and/or the strap 85B may alternatively be attached to, or adjacent to, the panel sides 52C, 52D, anywhere along such sides 52C, 52D and/or to any other portion of the panel 50 between the two sides 52C, 52D.

As depicted in FIG. 2A, the panel 52 has length L and height H. Typically, L and H will be dictated by the dimension of a container in which the nesting carrier 50 will be suspended. The container dimensions and the dimensions of the part 10 will together define the number of parts 10 that can be carried by the nesting carrier 50. In the illustrated embodiment, such dimensions allow four parts 10 to be carried by the nesting carrier 50, although with containers and/or parts of other dimensions the nesting carrier 50 may accommodate more or fewer parts. In some implementations, the nesting carrier 50 may be configured to hold two or more parts along the length L of the panel 52 and two or more parts between each set of gibs along the height of the panel 52. In such implementations, the openings defined through the panel 52 will be illustratively be modified to form two or more separate openings between the bottom 52B and the top 52A of the panel 52 between each set of gibs.

Turning now to FIG. 2B, the opposite face 52F of the panel 52 is shown, and it is through the face 52F of the panel 52 that the convex surfaces 16 of the parts 10 will extend into the opening $\mathbf{54}_1$-$\mathbf{54}_4$ and nest with corresponding ones of the parts 10 retained on or adjacent to the face 52E of the panel by the part retaining structures, e.g., $\mathbf{56}_1$-$\mathbf{56}_5$ and $\mathbf{58}_1$-$\mathbf{58}_4$. In this regard, the openings $\mathbf{54}_1$-$\mathbf{54}_4$ are illustratively sized to each receive the convex surface 16 of a respective part 10 therein through the face 52F of the panel 52 such that at least a portion of the convex surface 16 of each such part 10 extends through a respective opening $\mathbf{54}_1$-$\mathbf{54}_4$ and at least partially into a cavity 28 of a respective part 10 retained on or adjacent to the opposite face 52E with the concave surface 26 and cavity 28 thereof facing the respective opening $\mathbf{54}_1$-$\mathbf{54}_4$ through the face 52E. Additionally, the peripheries $\mathbf{55}_1$-$\mathbf{55}_4$ of the openings $\mathbf{54}_1$-$\mathbf{54}_4$ are each illustratively configured such that one or more portions engage the convex 16 surface of a part 10 extending into a respective one of the openings $\mathbf{54}_1$-$\mathbf{54}_4$ so as to nest at least a portion of that convex surface 16 within the cavity 28 of respective part 10 on the opposite side of the respective opening $\mathbf{54}_1$-$\mathbf{54}_4$ without contacting the concave surface 26 thereof.

In this regard, the peripheries $\mathbf{55}_1$-$\mathbf{55}_4$ of the openings $\mathbf{54}_1$-$\mathbf{54}_4$ illustratively include a number of engagement keys for engaging corresponding nesting keys defined on the convex surfaces 16 of the parts 10 and described above with respect to FIGS. 1A and 1B. In the illustrated embodiment in which the convex surfaces 16 of the parts 10 each define three nesting keys $\mathbf{20}_1$-$\mathbf{20}_3$ on and along one side thereof and two nesting keys $\mathbf{20}_4$, $\mathbf{20}_5$ on and along an opposite side thereof as described above with respect to FIGS. 1A and 1B, each of the peripheries $\mathbf{55}_1$-$\mathbf{55}_4$ likewise defines three spaced-apart engagement keys $\mathbf{80}_1$-$\mathbf{80}_3$ on and along one side thereof and two spaced-apart engagement keys $\mathbf{80}_4$, $\mathbf{80}_5$ on and along an opposite side thereof. The dimensions of the openings $\mathbf{54}_1$-$\mathbf{54}_4$ are illustratively arranged and selected such that the engagement keys $\mathbf{80}_1$-$\mathbf{80}_5$ align with the nesting keys $\mathbf{20}_1$-$\mathbf{20}_5$ of the parts 10, adjacent portions $\mathbf{82}_1$-$\mathbf{82}_7$ of the peripheries $\mathbf{55}_1$-$\mathbf{55}_4$ likewise align with respective ones of the border regions $\mathbf{18}_1$-$\mathbf{18}_7$ of the parts 10, and top and bottom portions $\mathbf{84}_1$, $\mathbf{84}_2$ respectively of the peripheries $\mathbf{55}_1$-$\mathbf{55}_4$ align with respective ones of the top and bottom regions 22A, 22B of the parts 10.

Figure 3:
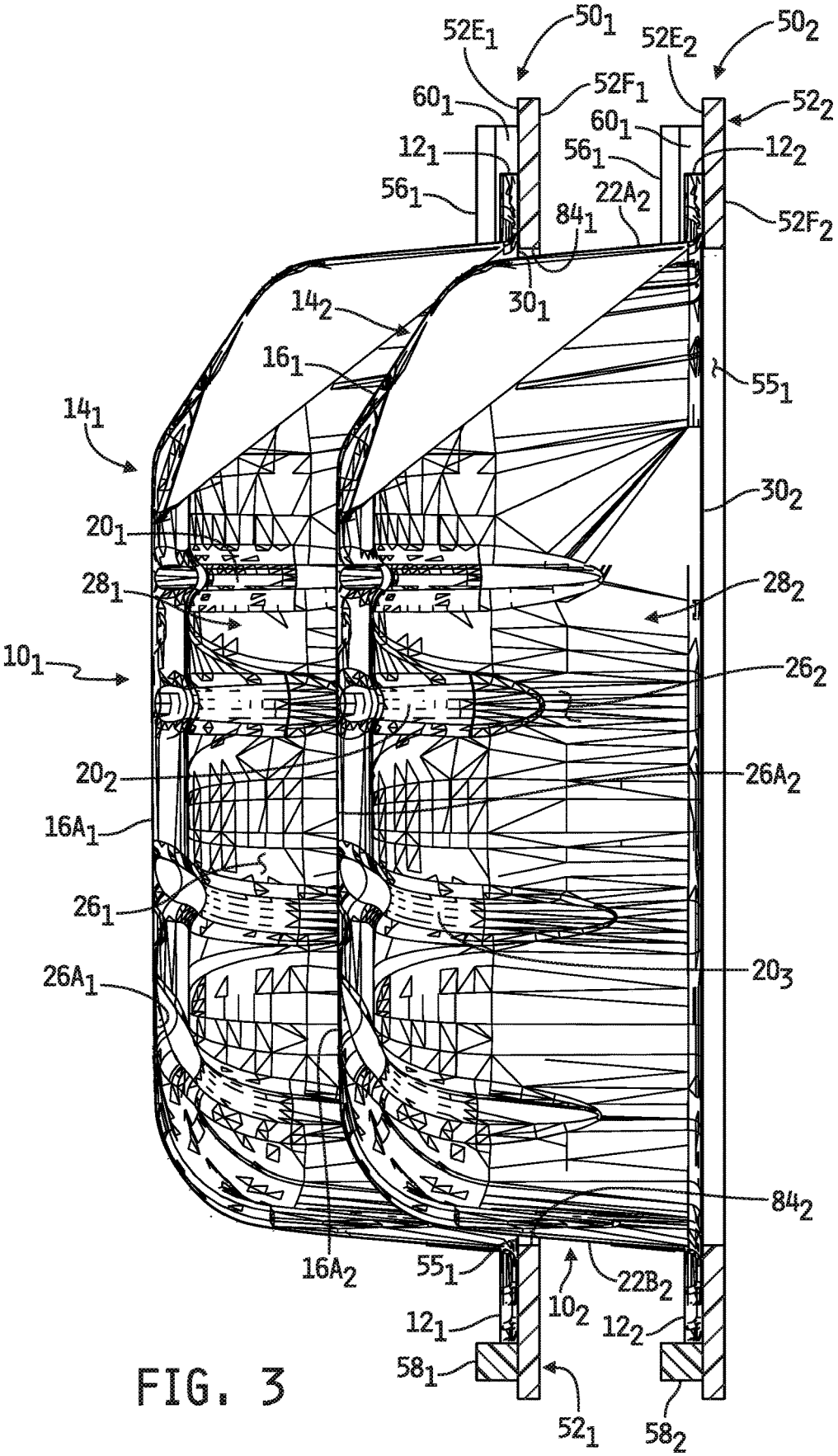
FIG. 3 is a cross-sectional view, as viewed along section lines 3-3 of FIG. 2B, showing a first part of the type illustrated in FIGS. 1A and 1B operatively positioned on the one face of the dunnage carrier with the concave surface of the first facing an opening defined through the dunnage carrier, and also showing the convex surface of a second identical part, positioned on another dunnage carrier, nested in contact with at least a portion of a periphery of the opening such that at least a portion of the convex surface of the second part extends into the first part spaced-apart from the concave surface thereof.

Referring now to FIG. 3, for example, a part $\mathbf{10}_1$ is shown positioned on or adjacent to a face $\mathbf{52}E_1$ of a panel $\mathbf{52}_1$ of a nesting carrier $\mathbf{50}_1$, e.g., via retaining structures $\mathbf{56}_1$, $\mathbf{56}_2$ and $\mathbf{58}_1$, such that the concave surface $\mathbf{26}_1$ and the cavity $\mathbf{28}_1$ thereof faces the opening $\mathbf{54}_1$ defined through the panel $\mathbf{52}_1$. Another part $\mathbf{10}_2$ is also shown positioned on or adjacent to a face $\mathbf{52}E_2$ of a panel $\mathbf{52}_2$ of another nesting carrier $\mathbf{50}_2$, e.g., via retaining structures $\mathbf{56}_1$, $\mathbf{56}_2$ and $\mathbf{58}_1$, such that the concave surface $\mathbf{26}_2$ and the cavity $\mathbf{28}_2$ thereof faces the opening $\mathbf{54}_1$ defined through the panel $\mathbf{52}_2$. The face $\mathbf{52}E_2$ of the panel $\mathbf{52}_2$ faces the face $\mathbf{52}F_1$ of the panel $\mathbf{52}_1$ such that the bottom surface $\mathbf{16}A_2$ of the convex surface $\mathbf{16}_2$ of the part $\mathbf{10}_2$ faces the opening $\mathbf{54}_1$ defined through the panel $\mathbf{52}_1$ and thus faces the concave surface $\mathbf{26}_1$ and the cavity $\mathbf{28}_1$ of the part $\mathbf{10}_1$.

Referring now to FIGS. 2B and 3, with the parts $\mathbf{10}_1$ and $\mathbf{10}_2$ positioned as illustrated in FIG. 3, the engagement keys $\mathbf{80}_1$-$\mathbf{80}_5$ of the panel $\mathbf{52}_1$ illustrated in FIG. 2B align with the nesting keys $\mathbf{20}_1$-$\mathbf{20}_5$ of the part $\mathbf{10}_2$, the portions $\mathbf{82}_1$-$\mathbf{82}_7$ of the peripheries $\mathbf{55}_1$-$\mathbf{55}_4$ of the panel $\mathbf{52}_1$ adjacent to the engagement keys $\mathbf{80}_1$-$\mathbf{80}_5$ illustrated in FIG. 2B likewise align with respective ones of the border regions $\mathbf{18}_1$-$\mathbf{18}_7$ of the part $\mathbf{10}_2$, and the top and bottom portions $\mathbf{84}_1$, $\mathbf{84}_2$ respectively of the peripheries $\mathbf{55}_1$-$\mathbf{55}_4$ of the panel $\mathbf{52}_1$ illustrated in FIG. 2B align with respective ones of the top and bottom regions 22A, 22B of the part $\mathbf{10}_2$. As the convex surface $\mathbf{16}_2$ of the part $\mathbf{10}_2$ is advanced into the opening $\mathbf{54}_1$ of the panel $\mathbf{52}_1$ from the face $\mathbf{52}F_1$ of the panel $\mathbf{52}_1$ and into the cavity $\mathbf{28}_1$ of the part $\mathbf{10}_1$, the engagement keys $\mathbf{80}_1$-$\mathbf{80}_5$ defined by the periphery $\mathbf{55}_1$ of the opening $\mathbf{54}_1$ of the panel $\mathbf{52}_1$ engage the nesting keys $\mathbf{20}_1$-$\mathbf{20}_5$ defined by the convex surface $\mathbf{16}_2$ of the part $\mathbf{10}_2$, the adjacent portions $\mathbf{82}_1$-$\mathbf{82}_7$ of the periphery $\mathbf{55}_1$ of the opening $\mathbf{54}_1$ likewise align with and engage respective ones of the border regions $\mathbf{18}_1$-$\mathbf{18}_7$ defined by the convex surface $\mathbf{16}_2$ of the part $\mathbf{10}_2$, and the top and bottom portions $\mathbf{84}_1$, $\mathbf{84}_2$ respectively of the periphery $\mathbf{55}_1$ align with and engage respective ones of the top and bottom regions 22A, 22B of the convex surface $\mathbf{16}_2$ of the part $\mathbf{10}_2$.

Because the cross-sectional areas of the cavities $\mathbf{28}_1$, $\mathbf{28}_2$ of the parts $\mathbf{10}_1$, $\mathbf{10}_2$ increase from the bottom surfaces $\mathbf{16}A_1/\mathbf{26}A_1$, $\mathbf{16}A_2/\mathbf{26}A_2$ toward the openings $\mathbf{30}_1$, $\mathbf{30}_2$ respectively as described above, resistance forces of the engagement keys $\mathbf{80}_1$-$\mathbf{80}_5$ defined by the periphery $\mathbf{55}_1$ of the opening $\mathbf{54}_1$ of the panel $\mathbf{52}_1$ acting on the nesting keys $\mathbf{20}_1$-$\mathbf{20}_5$ defined by the convex surface $\mathbf{16}_2$ of the part $\mathbf{10}_2$, resistance forces of the adjacent portions $\mathbf{82}_1$-$\mathbf{82}_7$ of the periphery $\mathbf{55}_1$ of the opening $\mathbf{54}_1$ acting on the border regions $\mathbf{18}_1$-$\mathbf{18}_7$ defined by the convex surface $\mathbf{16}_2$ of the part $\mathbf{10}_2$ and resistance forces of the top and bottom portions $\mathbf{84}_1$, $\mathbf{84}_2$ respectively of the periphery $\mathbf{55}_1$ acting on the top and bottom regions 22A, 22B of the convex surface $\mathbf{16}_2$ of the part $\mathbf{10}_2$ all increase as advancement of the convex surface $\mathbf{16}_2$ of the part $\mathbf{10}_2$ into the openings $\mathbf{54}_1$-$\mathbf{54}_4$ and into the cavity $\mathbf{28}_1$ of the part $\mathbf{10}_1$ continues. At some point during such advancement, the collective resistance forces of the engagement keys $\mathbf{80}_1$-$\mathbf{80}_5$ acting on the nesting keys $\mathbf{20}_1$-$\mathbf{20}_5$, of the adjacent portions $\mathbf{82}_1$-$\mathbf{82}_7$ acting on the border regions $\mathbf{18}_1$-$\mathbf{18}_7$ and of the top and bottom portions $\mathbf{84}_1$, $\mathbf{84}_2$ acting on the top and bottom regions 22A, 22B of the convex surface $\mathbf{16}_2$ of the part $\mathbf{10}_2$ increase sufficiently to prevent further advancement of the convex surface $\mathbf{16}_2$ of the part $10_2$ through the opening $54_1$ of the panel $52_1$ and into the cavity $28_1$ of the part $10_1$. In this position, at least a portion of the body or shell $14_2$ of the part $10_2$ is nested within the cavity $28_1$ of the part $10_1$ in non-contacting relationship with the part $10_1$ as illustrated by example in FIG. 3. The profiled periphery $55_1$ of the opening $54_1$ of the panel $52_1$ thus serves to engage the convex surface $16_2$ of the part $10_2$ to nest at least a portion of the body or shell $14_2$ of the part $10_2$ within the cavity $28_1$ of the part $10_1$ while at the same time also preventing the convex surface $16_2$ of the shell $14_2$ from advancing into contact with the concave surface $26_1$ of the part $10_1$.

In the position illustrated in FIG. 3, the part $10_2$ is illustratively prevented by the profiled periphery $55_1$ of the opening $54_1$ of the panel $52_1$ from moving in any direction parallel with an axial plane defined through the panel $52_1$. The part $10_2$ may, of course, be moved away from and out of the part $10_1$ and/or the part $10_1$ may be moved away from the part $10_2$ in a direction normal to the axial plane of the panel $52_1$.

In embodiments in which it is desirable to maximize the packing density of parts 10 in storage and/or transportation container, the peripheries $55_1$-$55_4$ of the panel openings $54_1$-$54_4$ are illustratively sized and configured to nest parts 10, as just described, with minimum, non-contacting distance between the convex surfaces 16 of the nesting parts $10_2$ and the concave surfaces of the parts $10_1$ in which they are nested. As some amount of movement of one or more parts 10 relative to one or more of the panels 52 may occur during transport, a flexible sheet 90 may optionally be attached, affixed or otherwise coupled to the panels 52 and sized to extend over the openings 54 as illustrated by dashed line representation in FIG. 2B. In the embodiment illustrated in FIG. 2B, the flexible sheet 90 is illustratively attached to the surface 52F of the panel 52 so that as parts 10 are advanced into the openings $54_1$-$54_4$ to nest with parts carried by the panel 52 as described above, such nesting parts 10 will carry respective portions of the flexible sheet 90 into the cavities 28 of the parts 10 in which they are nesting to as to provide a thin, physical barrier between the respective convex surfaces 16 and the concave surfaces 26 so as to prevent direct physical contact between such surfaces. In some such embodiments, the flexible sheet 10 may be or include a stretchable fabric or other textile, or other flexible material(s) having resiliency or memory so as to allow at least a portion of the material to extend, e.g., by stretching, into the cavity 28 of one part 10 as the convex surface 26 of another part 10 is passed into a respective opening 54 of a respective panel 52, and to allow such portion to return substantially to the position illustrated in FIG. 2B over the face 52F of the panel 52 and over the respective opening 54. It will be appreciated that, in embodiments in which it is desirable to provide a thin, physical barrier between nested parts 10 as just described, the flexible sheet 90 may be replaced or augmented with one or more flexible strips, pouches, fingers, or the like which may be made of the same or similar material(s) and which is/are operatively affixed, attached or otherwise coupled to the respective panel 52. In other embodiments in which it is not desirable or necessary to maximize the packing density of parts 10 in storage and/or transportation container, the peripheries $55_1$-$55_4$ of the panel openings $54_1$-$54_4$ may illustratively be sized and configured to nest parts 10, as just described, with greater than the minimum, non-contacting distance between the convex surfaces 16 of the nesting parts $10_2$ and the concave surfaces of the parts $10_1$ in which they are nested.

In one embodiment, the panels 52 are illustratively formed of a rigid or semi-rigid polypropylene foam. In some such embodiments, one or more polyester layers may be laminated or otherwise affixed to one or more portions of the face(s) 52E and/or 52F for abrasion reduction. In some alternate embodiments, the panels 52 may be formed of polyethylene or other suitable polymer, and in some such embodiments one or more low-abrasion layers may be laminated or otherwise affixed to one or more portions of the face(s) 52E and/or 52F. In other alternate embodiments, the panels 52 may be formed of metal or metal composite, and in some such embodiments one or more low-abrasion layers may be laminated or otherwise affixed to one or more portions of the face(s) 52E and/or 52F panels 52. In still other alternate embodiments, the panels 52 may be formed of one or more rigid, semi-rigid and/or flexible materials, and in any such embodiments the resulting panels 52 should allow for attachment of the gibs and stop members and should have sufficient stiffness and/or resiliency at and/or about the peripheries of the openings so as to maintain separation of the nested parts as described above.

In one embodiment, the gibs 56 and the stop members 58 are illustratively formed of a rigid or semi-rigid polymer or other suitable material. In alternate embodiments, the gibs and stop members may be formed of one or more rigid, semi-rigid and/or flexible materials, and in any such embodiments the resulting gibs and stop members should allow for slidable loading and unloading of parts onto and from the panels 52.

Referring now to FIGS. 4A and 4B, an embodiment is shown of a nested dunnage arrangement 100 including a container 102 in which a plurality of nesting carriers $50_1$-$50_N$ are supported in nesting relationship to one another, wherein N may be any positive integer. The container 102 is illustratively provided in the form of a cage or crate having four corner posts 102A-102B and a pair of guide rails 104A, 104B mounted opposite one another to the container 102, and has dimensions of width=W, depth=D and height=H. In the illustrated example, the guide rail 104A is secured to and between the corner posts 102A, 102B, and the guide rail 104B is secured to and between the corner posts 102C, 102D such that the guide rails 104A, 104B are approximately parallel with one another.

As best shown in FIG. 4B, the nesting carriers $50_1$-$50_N$ each include elongated poles 68 coupled at their opposite ends to gliders 70A, 70B (only the gliders 70A are shown in FIG. 4B). In the illustrated embodiment, the gliders 70A (and 70B) are provided in the form of conventional rollers, and the guide rails 104A (and 104B) defined a guide channel 108 between opposing gibs 106A, 106B. In any case, the nesting carriers $50_1$-$50_N$ are movable within the container 102 along the axial directions of the guide rails 104A, 104B.

Generally, each nesting carrier $50_1$-$50_N$ is configured to carry M parts 10, such that an N×M matrix of parts 10 can be stored in and/or transported by the dunnage container 102. In the example illustrated in FIGS. 4A-4B, each nesting carrier $50_1$-$50_N$ is illustratively configured to carry 4 parts 10 as described above with respect to FIGS. 2A and 2B, such that the capacity C of the container 102 is C=4×N. The width W of the container 102 defines the number of parts 10 per nesting carrier $50_1$-$50_N$ (or vice versa), the depth D of the container 102 defines the number N of nesting carriers $50_1$-$50_N$ which the container 102 may support in nesting relationship to one another (or vice versa), and the height H of the container 102 defines the maximum height of the parts 10 or the maximum number of parts 10 that may be held vertically by any one nesting carrier. In one example implementation, which should not be considered limiting in any way, the container 102 has W×D×H dimensions of 48 in×45 in×25 in., and with 4 parts 10 per nesting carrier 50 as illustrated in FIGS. 2A, 2B and 4B the container 102 holds 52 parts 10 nested together as illustrated by example in FIG. 4A and described herein. By way of comparison, a container having W×D×H dimensions of 48 in.×45 in.×50 in. may hold only 42 of non-nested parts 10 (e.g., packed back-to-back).

Referring now to FIG. 5, another embodiment is shown of a nested dunnage arrangement 200 including a sided container 202 in which a plurality of nesting carriers $\mathbf{50}_1$-$\mathbf{50}_M$ are supported in nesting relationship to one another, wherein M may be any positive integer. The container 202 illustratively has four walls, e.g., formed of a polymer or other suitable material, coupled together to form a closed structure with a pair of guide rails 204A, 204B mounted opposite one another to and within the container 202 (only the guide rail 204A shown). The guide rails 204A, 204B may illustratively be similar or identical to the guide rails 104A, 104B described above with respect to FIGS. 4A and 4B. In any case, the container 202 has dimensions of width=W, depth=D and height=H. Otherwise, the container 202 is configured to hold therein the number 4M of parts 10 in nested relationship as described above with respect to the container 102.

While the disclosure has been illustrated and described in detail in the drawings and foregoing description, such illustration and description is to be considered as exemplary and not restrictive in character, it being understood that only illustrative embodiments have been shown and described and that all changes and modifications consistent with this disclosure and appended claims are desired to be protected. For example, while the example nested dunnage arrangement illustrated in the figures is configured to orient the parts 10 vertically, i.e., with a plane formed by the face 12A of the flange 12 of each part 10 parallel with a plane formed axially through the panels 52 and with each such plane extending vertically within a container 100, 200, it will be understood that other container embodiments are envisaged in which the parts 10 are oriented horizontally, i.e., with the planes formed by the face 12A of the flange 12 of each part 10 and axially through the panels 52 extending horizontally within such containers, or oriented along a plane between horizontal and vertical, or in which some of the parts 10 are oriented within the container along a first plane and others are oriented within the container along a second plane that is generally not parallel with the first.

What is claimed is:

1. A nested dunnage arrangement for compactly storing or transporting parts each having a concave surface defining a cavity and a convex surface opposite the concave surface, the nested dunnage arrangement comprising:

a first panel defining a first opening therethrough and a panel top spaced apart from the first opening, and means for positioning and retaining a first one of the parts on one face of the first panel with the concave surface and the cavity of the first part facing and aligned with the first opening of the first panel, wherein the first opening is sized to receive therein from an opposite face of the first panel a convex surface of a second one of the parts such that the convex surface of the second part extends through the first opening and at least partially into the cavity of first part, and wherein at least a portion of a periphery of the first opening is configured to engage the convex surface of the second part received therein to nest at least a portion of the convex surface of the second part within the cavity of the first part while also preventing the convex surface of the second part from contacting the concave surface of the first part, and wherein the nested dunnage arrangement further comprises a support member mounted to the first panel at or near the panel top, a container configured to receive the first panel therein with the first panel suspended in the container by the support member and means coupled to the support member for moving the first panel relative to the container.

2. The nested dunnage arrangement of claim 1, further comprising a flexible sheet coupled to the opposite face of the first panel and extending over the first opening to form a physical barrier between the concave surface of the first part and the convex surface of the second part nested within the first part.

3. The nested dunnage arrangement of claim 2, wherein the flexible sheet is configured to be forced by the convex surface of the second part received in the first opening to extend through the first opening and at least partially into the cavity of the first part.

4. The nested dunnage arrangement of claim 1, further comprising:

a second panel defining a second opening therethrough, and means for positioning and retaining the second part on one face of the second panel with the concave surface and the cavity of the second part facing and aligned with the second opening of the second panel, the one face of the second panel facing the opposite face of the first panel.

5. The nested dunnage arrangement of claim 4, further comprising at least one flexible strap coupled to and between the first and second panels, the at least one flexible strap having a length sized to limit a distance between the one face of the second panel and the opposite face of the first panel.

6. The nested dunnage arrangement of claim 1, wherein the convex surfaces of the first and second parts each define at least one nesting key positioned between border portions, wherein the at least one nesting key is recessed into the convex surface relative to the border portions, and wherein the periphery of the first opening defines at least one engagement key configured to engage the at least one nesting key of the convex surface of the second part received therein.

7. The nested dunnage arrangement of claim 6, wherein the periphery of the first opening defines adjacent portions adjacent to the least one engagement key and configured to engage the border portions of the convex surface of the second part received therein.

8. The nested dunnage arrangement of claim 7, wherein the convex surfaces of the first and second parts each define a top surface at or near a top of the respective first and second part and a bottom surface opposite the top surface, and wherein the periphery of the first opening defines a top portion and a bottom portion opposite the top portion, the top and bottom portions of the periphery of the first opening configured to engage the top and bottom surfaces respectively of the convex surface of the second part received therein.

9. The nested dunnage arrangement of claim 1, wherein the convex surfaces of the first and second parts each define a top surface at or near a top of the respective first and second part and a bottom surface opposite the top surface, and wherein the periphery of the first opening defines a top portion and a bottom portion opposite the top portion, the top and bottom portions of the periphery of the first opening configured to engage the top and bottom surfaces respectively of the convex surface of the second part received therein.

10. A nested dunnage arrangement for compactly storing or transporting parts each having a concave surface defining a cavity, a convex surface opposite the concave surface and a flange extending about periphery of the convex surface adjacent to an opening to the cavity, the nested dunnage arrangement comprising:

a first panel defining a first opening therethrough, and a first plurality of gibs mounted to one face of the first panel at least partially about a periphery of the first opening, the first plurality of gibs configured to engage and retain a first one of the parts on the one face of the first panel with the concave surface and the cavity of the first part facing and aligned with the first opening of the first panel, the first plurality of gibs including first and second elongated gibs each mounted to the one face of the first panel on opposite sides of the periphery of the first opening, the first panel and the first and second gibs together defining elongated, opposing channels therebetween sized to slidlingly receive the flange of the first part therein to position and retain the first part on the one face of the first panel with the concave surface and the cavity of the first part facing and aligned with the first opening of the first panel, wherein the first opening is sized to receive therein from an opposite face of the first panel a convex surface of a second one of the parts such that the convex surface of the second part extends through the first opening and at least partially into the cavity of first part, and wherein at least a portion of a periphery of the first opening is configured to engage the convex surface of the second part received therein to nest at least a portion of the convex surface of the second part within the cavity of the first part while also preventing the convex surface of the second part from contacting the concave surface of the first part.

11. The nested dunnage arrangement of claim 10, wherein the first plurality of gibs includes a third gib mounted to the one face of the first panel below the periphery of the first opening, the third gib configured to support the flange of the first part positioned on the one face of the first panel with the concave surface and the cavity of the first part facing and aligned with the first opening of the first panel.

12. The nested dunnage arrangement of claim 10, wherein the first panel defines a second opening therethrough spaced apart from the first opening, and further comprising a second plurality of gibs mounted to the one face of the first panel at least partially about a periphery of the second opening, the second plurality of gibs configured to engage and retain a third one of the parts on the one face of the first panel with the concave surface and the cavity of the third part facing and aligned with the second opening of the first panel.

13. The dunnage arrangement of claim 12, wherein the second opening is sized to receive therein from an opposite face of the first panel a convex surface of a fourth one of the parts such that the convex surface of the fourth part extends through the second opening and at least partially into the cavity of third part, and wherein at least a portion of a periphery of the second opening is configured to engage the convex surface of the fourth part received therein to nest at least a portion of the convex surface of the fourth part within the cavity of the third part while also preventing the convex surface of the fourth part from contacting the concave surface of the third part.

14. A nested dunnage arrangement for compactly storing or transporting parts each having a concave surface defining a cavity, and a convex surface opposite the concave surface each of the plurality of panels defines a panel top spaced apart from the at least one opening defined therethrough, the nested dunnage arrangement comprising:

a dunnage container, a plurality of panels spaced apart from one another in the dunnage container, each of the plurality of panels defining at least one opening therethrough and a panel top spaced apart from the at least one opening, and a plurality of part retaining structures each coupled to one face of a respective one of the plurality of panels at least partially about the at least one opening defined therethrough, each of the plurality of part retaining structures configured to receive and retain a respective one of the parts on the one face of a respective one of the plurality of panels with the concave surface and the cavity of the respective part facing and aligned with the at least one opening defined through the respective one of the plurality of panels, wherein the at least one opening defined through each of the plurality of panels is sized to receive therein from an opposite face of the panel a convex surface of another of the parts carried by one of the plurality of part retaining structures coupled to an adjacent one of the plurality of panels such that convex surface of the another part extends through the at least one opening and at least partially into the cavity of the one part, and wherein at least a portion of a periphery of the at least one opening defined through each of the plurality of panels is configured to engage the convex surface of the another part received therein to nest at least a portion of the convex surface of the another part within the cavity of the one part while also preventing the convex surface of the another part from contacting the concave surface of the one part, and further comprising a plurality of support members each mounted to a different one of the plurality of panels at or near the panel top thereof, means for suspending each of the plurality of panels in the container by a respective one of the plurality of support members and means coupled to each of the plurality of support members for moving a respective one of the plurality of panels relative to the container.

15. The nested dunnage arrangement of claim 14, further comprising a plurality of flexible straps, at least one of the plurality of flexibles strap coupled to and between each adjacent pair of the plurality of panels, each of the plurality of flexible straps having a length sized to limit a distance between each adjacent pair of the plurality of panels.

* * * * *